US007688304B2

(12) United States Patent
Park

(10) Patent No.: US 7,688,304 B2
(45) Date of Patent: Mar. 30, 2010

(54) LIQUID CRYSTAL DISPLAY DEVICE AND METHOD OF MODIFYING IMAGE SIGNALS FOR THE SAME

(75) Inventor: Bong-Im Park, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1285 days.

(21) Appl. No.: 11/133,506

(22) Filed: May 20, 2005

(65) Prior Publication Data

US 2006/0092110 A1 May 4, 2006

(30) Foreign Application Priority Data

Oct. 29, 2004 (KR) ..... 10-2004-0087233

(51) Int. Cl.
*G09G 3/36* (2006.01)

(52) U.S. Cl. ..... 345/101; 345/89; 345/204; 345/690

(58) Field of Classification Search ..... 345/89, 345/94, 99, 204, 690–693, 101
See application file for complete search history.

(56) References Cited

U.S. PATENT DOCUMENTS 7,034,788 B2 * 4/2006 Someya et al. ..... 345/89
7,038,647 B2 * 5/2006 Shigeta et al. ..... 345/89
2006/0061828 A1 * 3/2006 Park ..... 358/300

FOREIGN PATENT DOCUMENTS

CN 1450521 6/2008

* cited by examiner

*Primary Examiner*—Richard Hjerpe
*Assistant Examiner*—Jennifer T Nguyen
(74) *Attorney, Agent, or Firm*—Cantor Colburn LLP

(57) ABSTRACT

A liquid crystal display (LCD) device comprises a liquid crystal panel assembly having pixels and thin film transistors, a sensor sensing temperature, a image signal modifying portion receiving image signals and the temperature, calculating a plurality of reference data for modification with respect to the temperature using coefficient of quadratic equation, and generating modified images signals according to the reference data for modification for the image signals for previous and current frame; and a data driving portion converting the modified image signals into data voltages and supplying the data voltages to the liquid crystal panel assembly. According to this configuration, the liquid crystal display device may reduce the size of the memory by calculating modified image signals with respect to the temperature using PQI.

14 Claims, 8 Drawing Sheets

LIQUID CRYSTAL DISPLAY DEVICE AND METHOD OF MODIFYING IMAGE SIGNALS FOR THE SAME

BACKGROUND OF THE INVENTION

1. Field of the Invention

The present invention relates to liquid crystal displays (LCDs), and more particularly, to a liquid crystal display device having modified image signals and a method of modifying same.

2. Description of the Related Art

Liquid crystal displays (LCDs) are widely used as flat display devices. LCDs comprise a liquid crystal panel having two opposing substrates (e.g. a thin film transistor (TFT) and a color filter (CF) substrate) and a liquid crystal layer disposed between the two opposing substrates.

LCDs display image data in response to movement of liquid crystal material caused by voltages applied from external source. However, since the movement of the liquid crystal material does not reach a desired level in a certain time period (e.g. in one frame), the LCD device, especially a device that has many moving images, cannot display the desired data exactly in a frame as known in the art. Several attempts have been made to solve this problem, such as driving methods that are used to raise a response time of the liquid crystal material (e.g. dynamic capacitance compensation (DCC) method). The DCC method compares image signals for a previous frame and image signals for the current frame, and generates new modified signals according to results of the comparison. In other words, when a level of the image signal for the current frame is more than that of the image signal for the previous frame, the DCC method generates a new modified signal that is at a higher level than the image signal for the current frame, and vice versa. However, one drawback to the DCC method is that the LCDs display different images even at the same gray level, i.e., a level of the image signal, by variation in temperature.

SUMMARY OF THE INVENTION

The present invention provides a liquid crystal display (LCD) device and a method of modifying image signals that can improve a response time of liquid crystal material by minimizing modification errors of the image signals in consideration of non-linearity of the inherent liquid crystal material using varying temperatures.

In one embodiment, a liquid crystal display (LCD) device comprises a liquid crystal panel assembly; a sensor, the sensor senses temperature; an image signal modifying portion, the image signal modifying portion receiving image signals and the temperature, calculating a plurality of reference data for modification for image signals for previous and current frames with respect to the temperature using coefficients of quadratic equation, and generating modified images signals according to the plurality of the reference data for modification; and a data driving portion, the data driving portion converting the modified image signals into data voltages and supplying the data voltages to the liquid crystal panel assembly.

Further, a method of modifying image signals comprises sensing temperature; calculating reference data for modification for image signals for previous and current frames with respect to the temperature using coefficients of quadratic equation; and generating modified image signals by an interpolation method using the reference data for modification.

These and other objects, features and advantages of the present invention will become apparent from the following detailed description of embodiments thereof, which is to be read in connection with the accompanying drawings.

BRIEF DESCRIPTION OF THE DRAWINGS

The above and other features and advantage points of the present invention will become more apparent by describing in detailed embodiments thereof with reference to the accompanying drawings, in which.

DETAILED DESCRIPTION OF THE INVENTION

Hereinafter the embodiments of the present invention will be described in detail with reference to the accompanied drawings.

Figure 1:
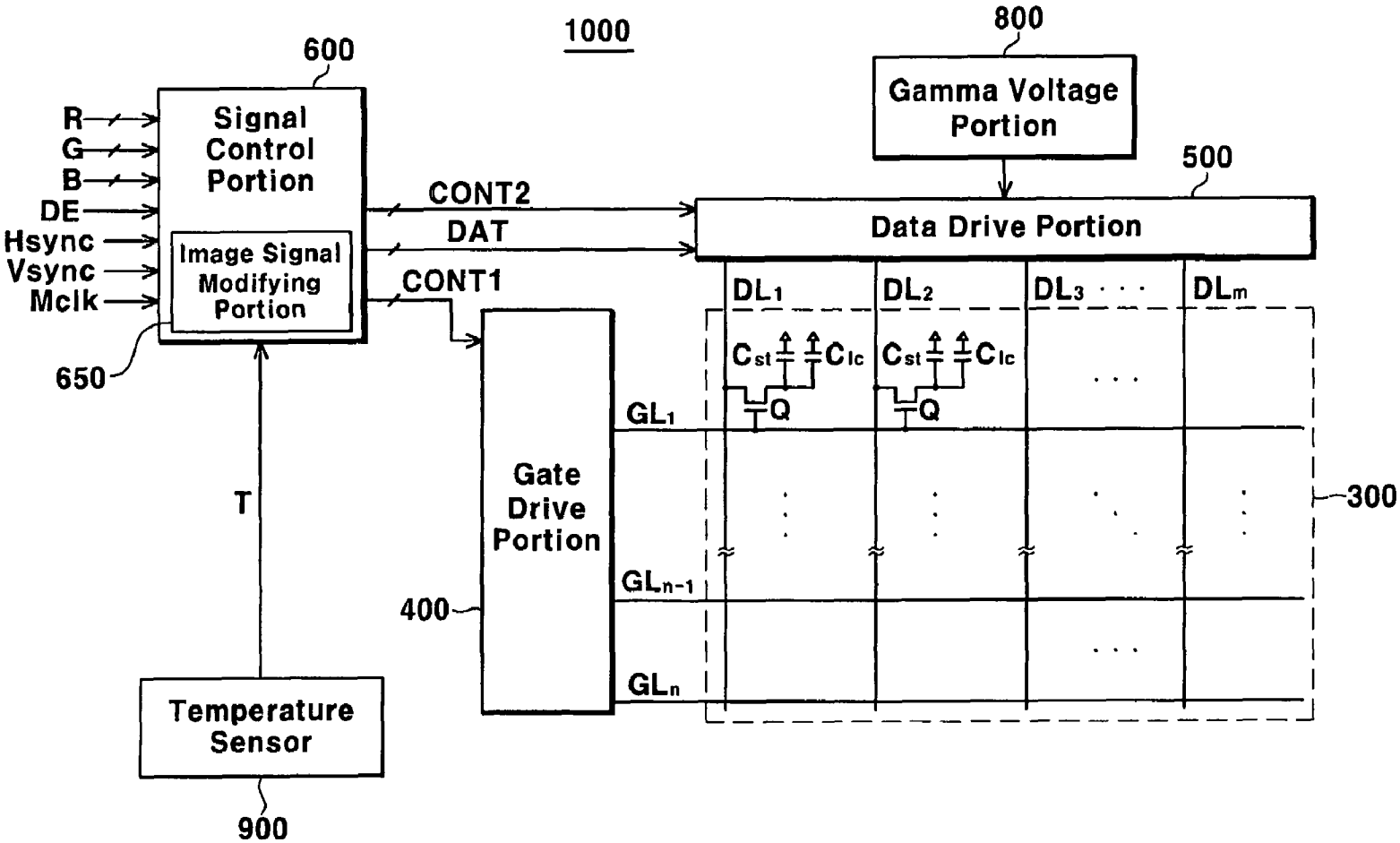
FIG. 1 is a block diagram of a liquid crystal display (LCD) device according to exemplary embodiments.
Figure 2:
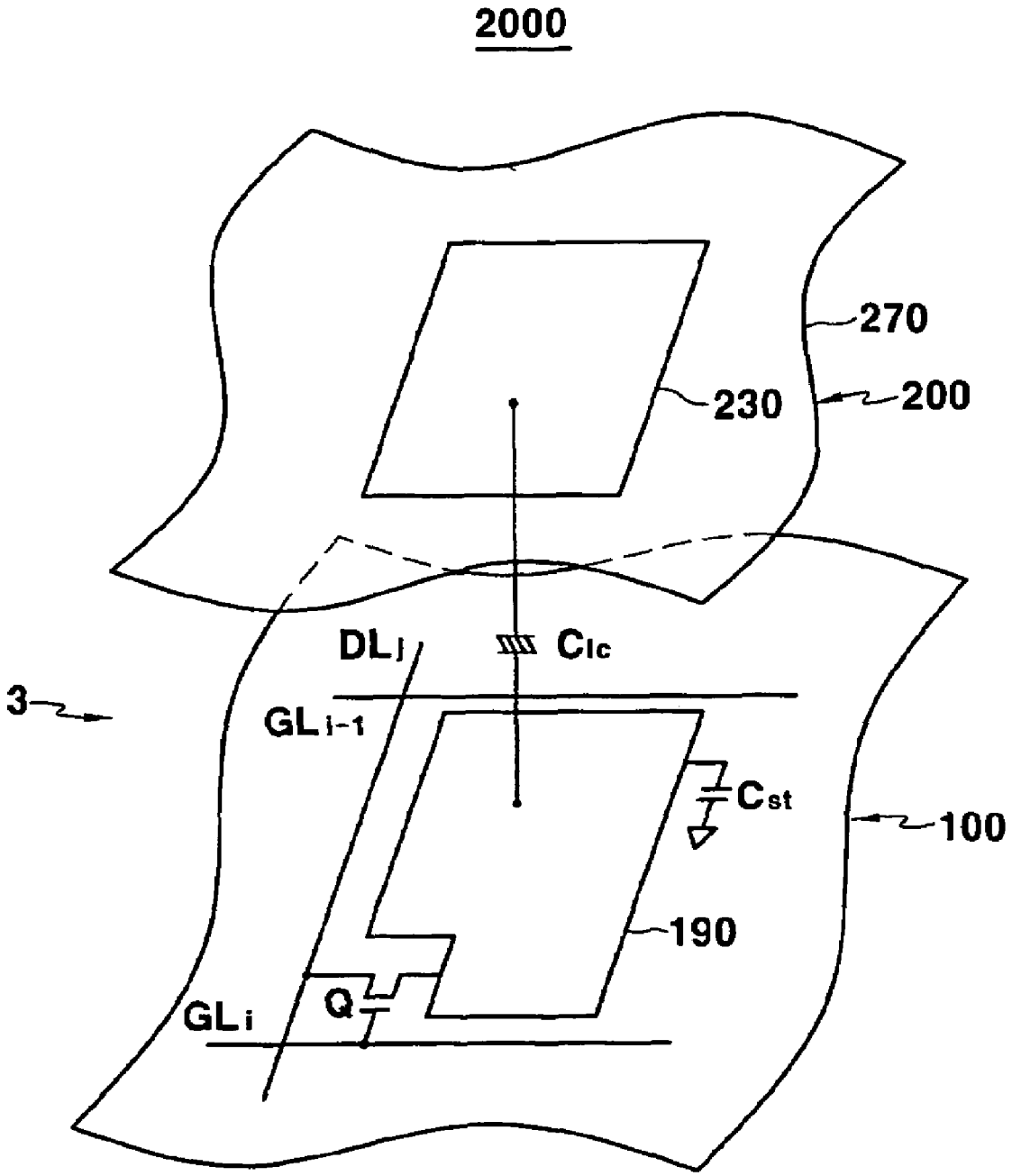
FIG. 2 is an equivalent circuit diagram for a pixel in the LCD device of FIG. 1 in accordance with exemplary embodiments.

FIG. 1 is a block diagram of a liquid crystal display (LCD) device in accordance with exemplary embodiments, and FIG. 2 is an equivalent circuit diagram for a pixel in the LCD device of FIG. 1 in accordance with exemplary embodiments.

As shown in FIG. 1, an LCD device 1000 comprises a liquid crystal panel assembly 300, a gate drive portion 400, a data drive portion 500, a gamma voltage portion 800, a signal control portion 600, and a temperature sensor 900.

The liquid crystal panel assembly 300 comprises multiple display signals (e.g. gate lines $GL_1$-$GL_n$ and data lines $DL_1$-$DL_m$) and arrayed in a matrix. The gate lines $GL_1$-$GL_n$ deliver gate signals and the data lines $DL_1$-$DL_m$ deliver data signals. As shown in FIG. 2, each pixel 2000 has a switching element Q connected to a gate line and a data line of the gate lines $GL_1$-$GL_n$ and data lines $DL_1$-$DL_m$, a liquid crystal capacitor $C_{lc}$, and optionally a storage capacitor $C_{st}$. The switching element Q is formed on a lower substrate 100 and has three terminals. The liquid crystal capacitor $C_{lc}$ represents a capacitor that a liquid crystal layer 3 is disposed between the pixel electrode 190 and a common electrode 270. The common electrode 270 is formed on an upper substrate 200. Further, the common electrode 270 may be formed on the lower substrate 100. The storage capacitor $C_{st}$ represents a capacitor where a separate signal line (not shown) formed on the lower substrate 100 overlaps the pixel electrode 190. Further, the storage capacitor $C_{st}$ may form a capacitor where the pixel electrode 190 overlaps a previous gate line.

The gamma voltage portion 800 includes two groups of gamma voltages, for example, one group has higher voltages and another group has lower voltages than a common voltage. The number of the gamma voltages provided may be adjustable based on the resolution of the LCD.

The gate drive portion 400 includes a plurality of gate drivers $GDI_1$-$GDI_p$ (not shown) and the gate drivers $GDI_1$-$GDI_p$ are connected to the gate lines $GL_1$-$GL_n$. The gate drive portion 400 applies a gate signal to the gate lines $GL_1$-$GL_n$ in order to turn on and off the switching elements Q. Further, the gate drive portion 400 may be formed on the lower substrate 100.

The data drive portion 500 includes a plurality of data drivers $DDI_1$-$DDI_q$ (not shown) and the data drivers $DDI_1$-$DDI_q$ are connected to the data lines $DL_1$-$DL_m$. The data drive portion 500 applies a desired image signal to the data lines $DL_1$-$DL_m$ by selecting a certain gamma voltage corresponding to image signals from the gamma voltage portion 800. The gate drivers $GDI_1$-$GDI_p$ and the data drivers $DDI_1$-$DDI_q$ may be formed by attaching a TCP (Tape Carrier Package)(not shown) to the liquid crystal panel assembly 300, and may be directly mounted on the lower substrate 100, for example, COG (Chip On Glass).

The temperature sensor 900 senses a temperature T of the liquid crystal panel assembly 300 and outputs the temperature to the signal control portion 600. The temperature sensor 900 may be mounted on the liquid crystal panel assembly 300 and may be implemented by a TFT applied to the liquid crystal panel assembly 300. The temperature sensor 900 may use a leakage current of the TFT as the value corresponding to the temperature T.

The signal control portion 600 comprises a image signal modifying portion 650, and controls operation of the gate drive portion 400 and the data drive portion 500. The image signal modifying portion 650 modifies input image signals R, G, B for improving a response time of liquid crystal material according to the input image signals R, G, B from a graphic controller (not shown) and temperature from the temperature sense portion 900.

Turning now to FIG. 1, operation of the LCD device 1000 will now be described in accordance with exemplary embodiments.

The signal control portion 600 receives an input control signals (Vsync, Hsync, Mclk, DE) from a graphic controller (not shown) and input image signals (R, G, B) and generates image signals (R', G', B'), gate control signals CONT1, and data control signals CONT2 in response to the input control signals and the input image signals. Further, the signal control portion 600 sends the gate control signals CONT1 to the gate drive portion 400 and the data control signals CONT2 to the data drive portion 500. The gate control signals CONT1 include STV indicating start of one frame, CPV controlling an output timing of the gate on signal, and OE indicating an ending time of one horizontal line, etc. The data control signals CONT2 include STH indicating start of one horizontal line, TP or LOAD instructing an output of data voltages, RVS or POL instructing polarity reverse of data voltages with respect to a common voltage, etc.

The data drive portion 500 receives the image signals R', G', B' from the signal control portion 600 and outputs the data voltages by selecting gamma voltages corresponding to the image signals R', G', B' according to the data control signals CONT2. The gate drive portion 400 applies the gate on signal according to the gate control signals CONT1 to the gate lines and turns on the switching elements Q connected to the gate lines.

Turning now to FIGS. 3-8, a method of modifying image signals of the LCD device 1000 will now be described in accordance with exemplary embodiments.

Figure 3:
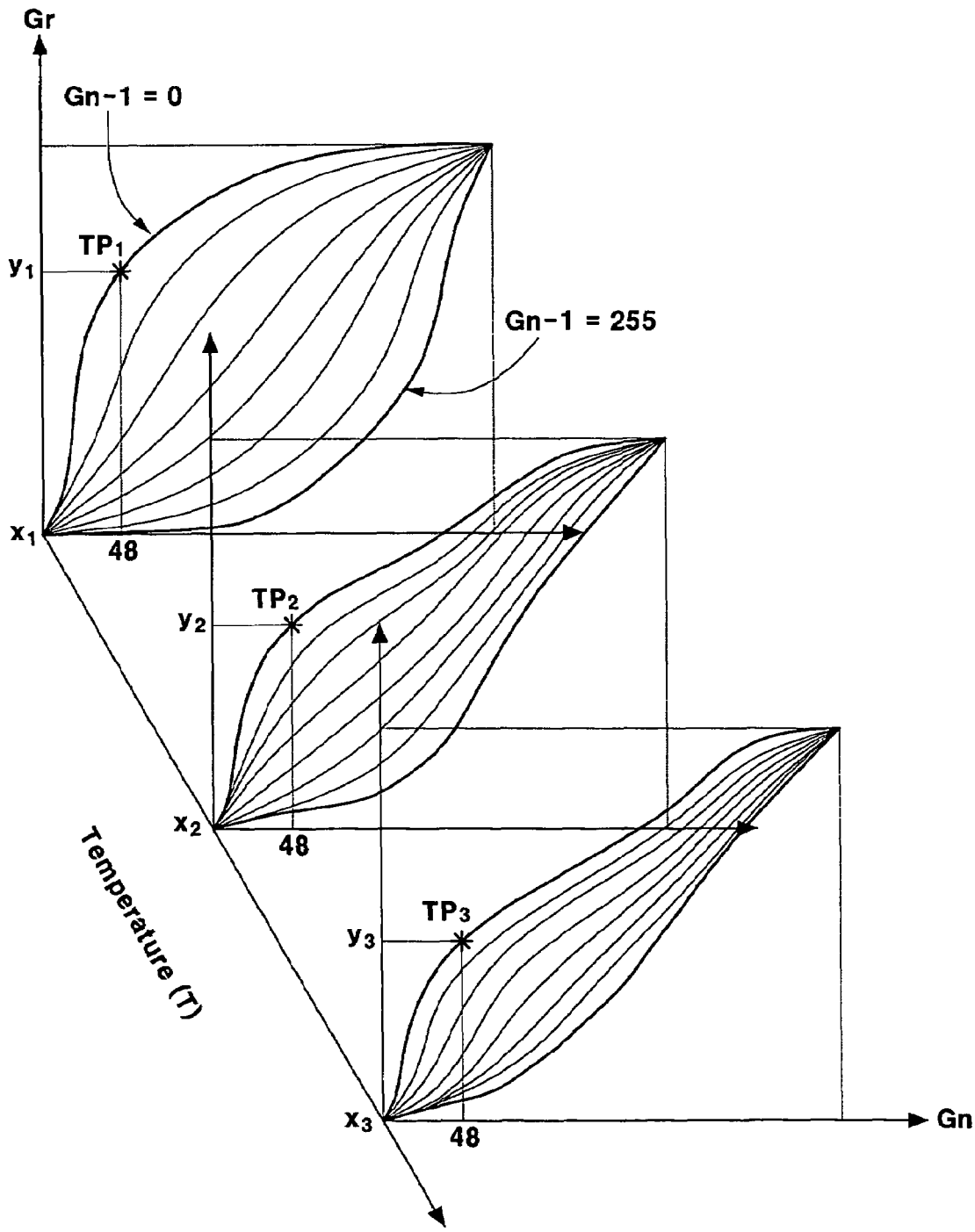
FIG. 3 is a graphical view of sample DCC data corresponding to image signals applied for previous frame and image signals for current frame, and temperature in accordance with exemplary embodiments.
Figure 4:
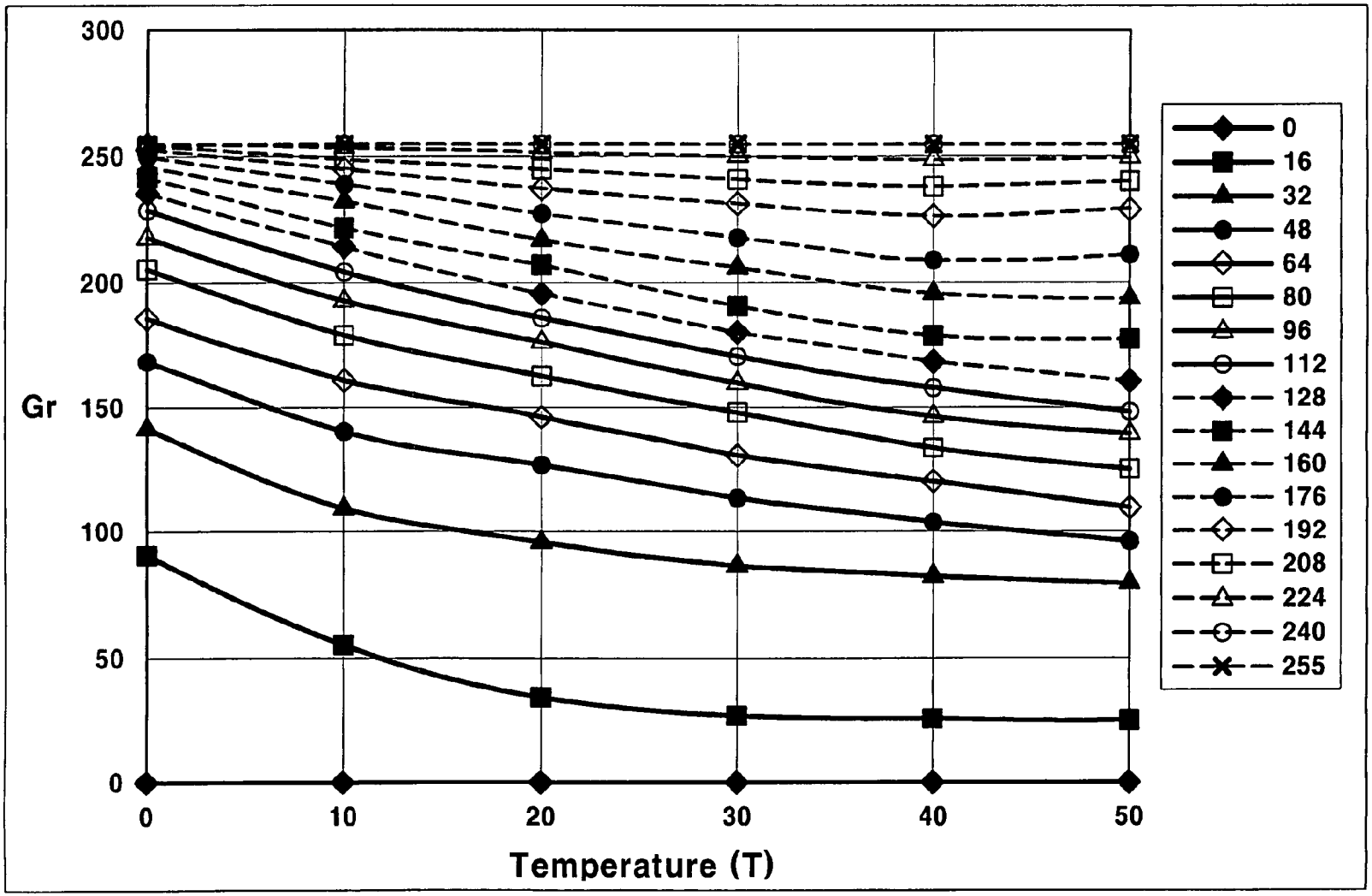
FIG. 4 is a graphical view of sample DCC data corresponding to image signals applied for the current frame and the temperature when an image signal for the previous frame is "0" in accordance with exemplary embodiments.
Figure 5:
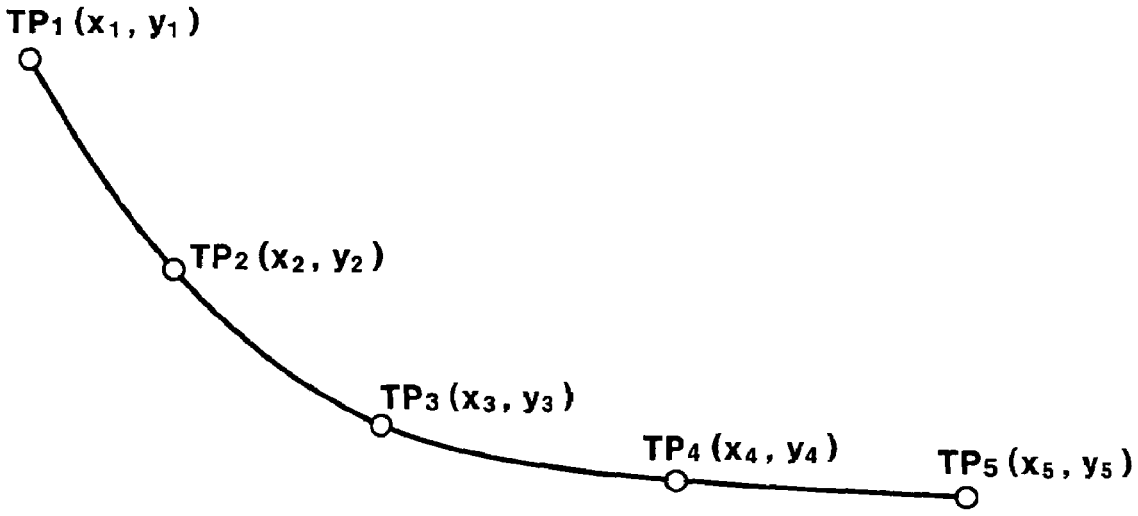
FIG. 5 is a graphical view of a method of modifying DCC data using varying temperatures in accordance with exemplary embodiments.
Figure 6:
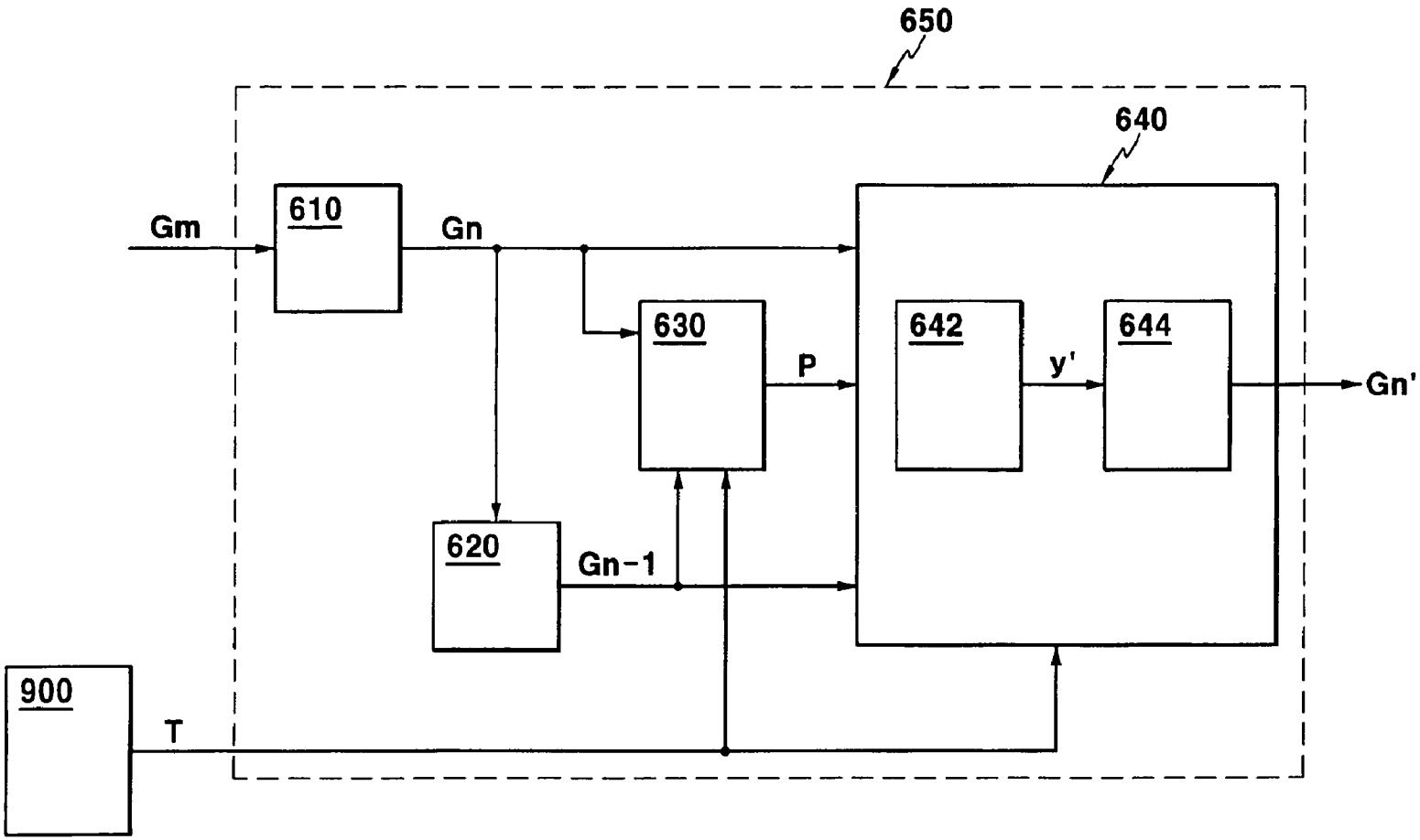
FIG. 6 is a block diagram of an image signal modifying portion in accordance with exemplary embodiments.
Figure 7:
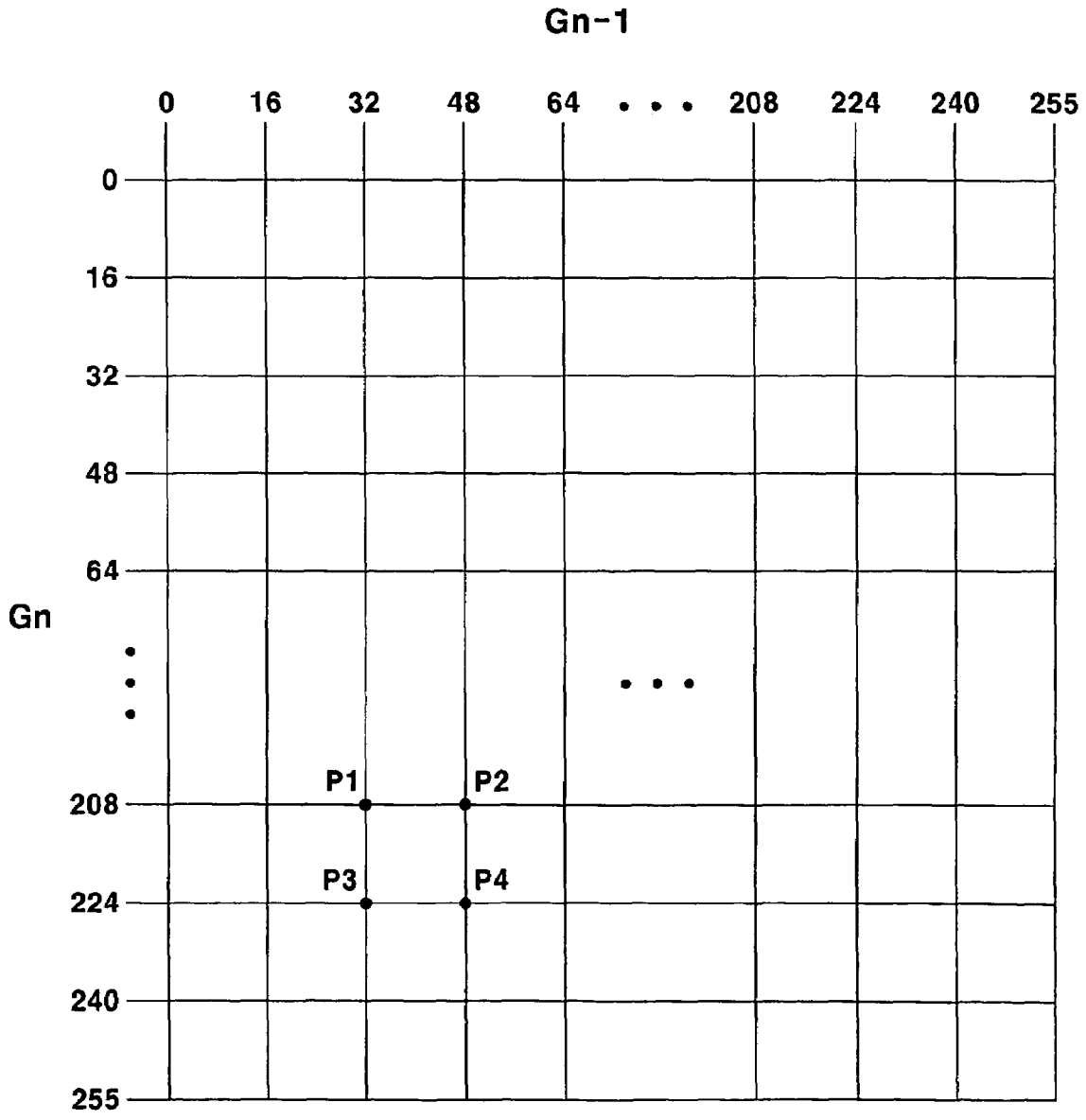
FIG. 7 is a graphical view of a sample of a look-up table (LUT) in accordance with exemplary embodiments.
Figure 8:
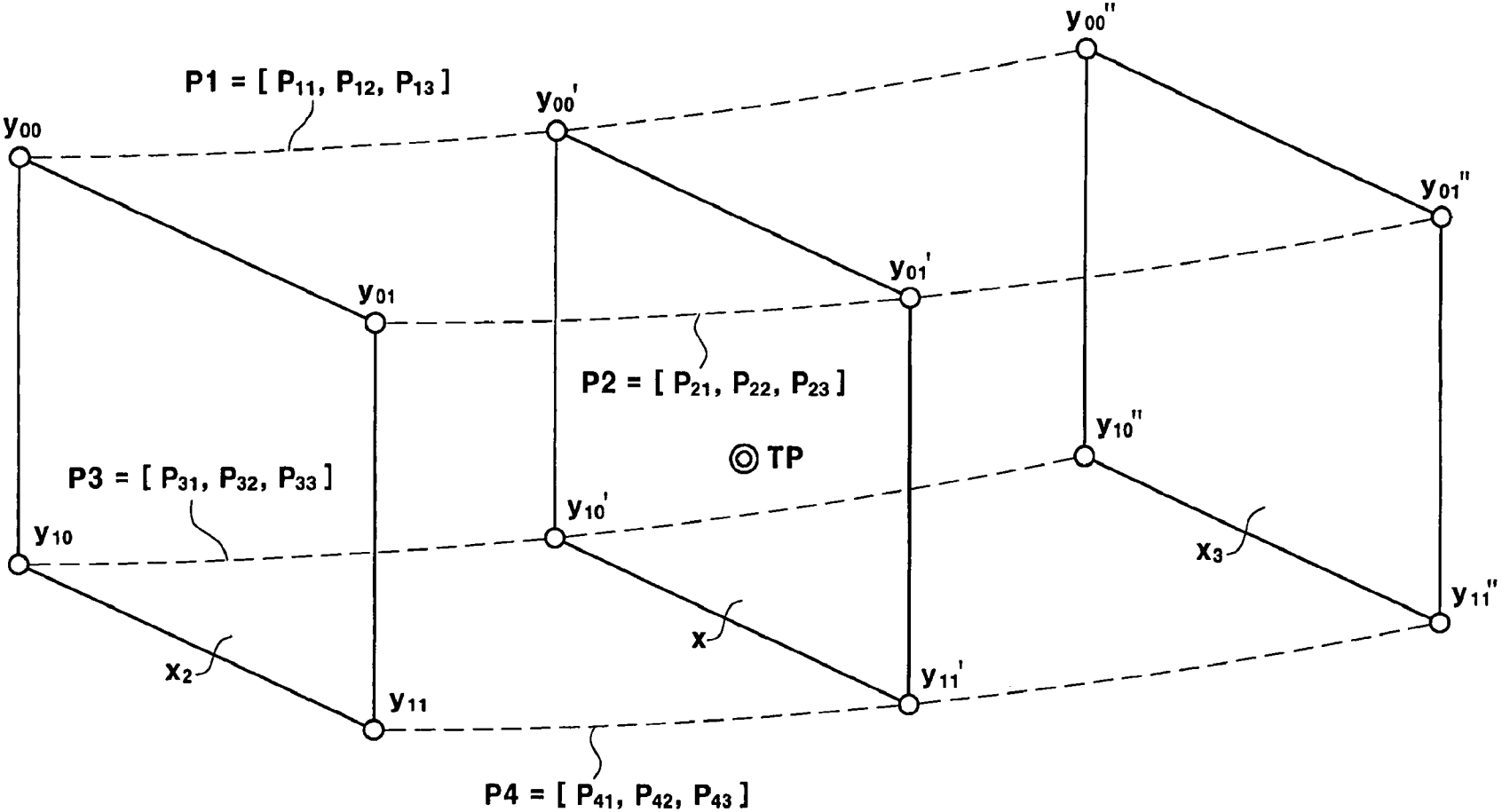
FIG. 8 is a prospective view of a method of modifying the image signals for the LCD of FIG. 1 in accordance with exemplary embodiments.

FIG. 3 is a graphical view of DCC data according to image signals for previous frame and image signals for current frame, and temperature, FIG. 4 is a graphical view of DCC data according to the image signals for the current frame and the temperature when an image signal for the previous frame is "0", and FIG. 5 is a graphical view of a method of modifying DCC data with respect to the temperature according to an exemplary embodiment. FIG. 6 is a block diagram of an image signal modifying portion according to an exemplary embodiment, FIG. 7 is a graphical view of an example of a look-up table (LUT) according to an exemplary embodiment, and FIG. 8 is a prospective view of a method of modifying the image signals according to an exemplary embodiment.

Herein, Image signals for the current frame indicate image signals for the nth frame, Gn and image signals for the previous frame indicate image signals for (n−1)th frame, Gn−1.

Referring to FIG. 3, DCC data Gr indicate modified data satisfying a desired response time with respect to the image signals for previous and current frames, Gn−1, Gn, and is previously set by experimental results. Further, the DCC data Gr have different modified image signals even in the same gray levels as the temperature of the LCD device varies. When the image signal for previous frame, Gn−1 is "0" gray level and the image signal for current frame Gn is "48" gray level, and the temperature T is $x_1$, the DCC data, Gr is $y_1$. When the temperature T is $x_2$, the DCC data, Gr is $y_2$, and the temperature T is $x_3$, the DCC data, Gr is $y_3$. When $TP_1$ ($x_1$, $y_1$), $TP_2$ ($x_2$, $y_2$), and $TP_3$ ($x_3$, $y_3$) are connected, variations in the DCC data, Gr with respect to the temperature T as shown in FIG. 4.

In accordance with exemplary embodiments, the DCC data, Gr, as shown in FIG. 4, have non-linear characteristics at less than about 20° C. and linear characteristics at more than about 20° C. In this embodiment, a method of modifying image signals include calculating modified image signals Gn' using the DCC data, Gr of the non-linear characteristics. The DCC data Gr is stored in a look-up table and correspond to a combination of upper bits of the image signals for previous and current frames, Gn−1, Gn, for example, 17×17 or 9×9 combination. The method includes using the DCC data, Gr as references of the DCC data. The method further includes calculating modified image signals Gn' by a piecewise quadratic interpolation (PQI) using the DCC data Gr occurring as a result of the temperature modification for a combination of the remaining bits except for the upper bits of the image signals.

Turning now to FIG. 5, a method of modifying image signals (R', G', B') using the PQI will now be described in accordance with exemplary embodiments.

Modified image signals Gn' with respect to any temperature x between TP1 ($x_1$, $y_1$), TP2 ($x_2$, $y_2$), TP3 ($x_3$, $y_3$), TP4 ($x_4$, $y_4$), and TP5 ($x_5$, $y_5$) may be calculated as follows. Herein, $x_1$ to $x_5$ refer to reference temperatures used in calculating the modified image signals, and $y_1$ to $y_5$ are DCC reference data with respect to each of the reference temperatures, $x_1$ to $x_5$. A distance between the reference temperatures gets narrower in the temperature section that is less than about 20° C., for example and gets wider in the temperature section that is more than about 20° C., for example, and thus a memory (now shown) storing values of the look-up table may be effectively used. For example, the reference temperatures, $x_1$ to $x_5$ may be set as 0° C., 10° C., 20° C., 30° C., 35° C., and 50° C., respectively. Further, the reference temperatures, $x_1$ to $x_5$ may be set according to the size of the memory and the temperature of DCC data, Gr, etc.

First, a coefficient of quadratic equation, $X_1$ ($p_1$, $p_2$, $p_3$), which connects three points, i.e. TP1, TP2, and TP3, is obtained as follows.

$$y=p_1x^2+p_2x+p_3 \quad \text{[Equation 1]}$$

If Eq. 1 is described as vector, it becomes $AX_1=B$. In case of $A=[x_1^2, x_1, 1; x_2^2, x_2, 1; x_3^2, x_3, 1]$, $B=[y_1; y_2; y_3]$, and $X_1=[p_1, p_2, p_3]$, $X_1$ may be obtained as follows.

$$X_1=A^{-1}B \quad \text{[Equation 2]}$$

Reference data for modification at temperature x between $TP_1$ and $TP_3$ may be obtained by the Equation 1. In the same way, a coefficient of quadratic equation, $X_2$, which connects three points, i.e. TP2, TP3, TP4 may be obtained. In other words, reference data for modification at temperature x between $TP_2$ and $TP_4$ may be obtained by a coefficient of quadratic equation, $X_2$. Further, a coefficient of quadratic equation, $X_3$, which connects three points, i.e. TP3, TP4, TP5 may be obtained. In other words, reference data for modification at temperature x between TP3 and TP5 may be obtained by a coefficient of quadratic equation, $X_3$.

The reference data for modification between TP2 and TP3 may be obtained by one of the coefficients of quadratic equation, $X_2$ and $X_3$. However, the reference data for modification may be obtained by a coefficient closer to measured values by comparing calculated values by $X_1$ and $X_2$ using Least Square Approximation method with the measured values. In this way, the reference data for modification between TP3 and TP4 may be obtained by one of coefficients of quadratic equation, $X_2$ and $X_3$. As a result, the reference data for modification between TP1 and TP5 may be more approximated to the measured values as the number of the reference temperatures increases.

The reference data for modification between TP1 and TP5 may be obtained by the coefficient of quadratic equation, $X_1$ between $TP_1$ and $TP_3$ and the coefficient of quadratic equation, $X_3$ between TP3 and TP5. Accordingly, the number of parameters stored in the LUT may be reduced and thus the size of the memory may be reduced.

Accordingly, all the coefficients of quadratic equation with respect to a combination of the remaining bits of the image signals for previous and current frames Gn−1, Gn are obtained by the PQI and stored in the LUT. Then, the reference data for modification are calculated with respect to the image signals for previous and current frames Gn−1, Gn and temperature T, and modified image signals Gn' are generated by the reference data for modification.

An image signal modifying portion for the LCD device will be described in detail with reference to the accompanying drawings.

As shown in FIG. 6, the image signal modifying portion 650 comprises a signal receiving portion 610, a memory 620, a look-up table (LUT) 630, and an operation processing portion 640. The image signal modifying portion 650 may be installed in the signal control portion 600. The LUT 630 and the operation processing portion 640 receive temperature T from a sensor 900.

The signal receiving portion 610 receives input image signals Gm from a signal source (not shown) and converts the input image signals Gm into image signals Gn. The signal receiving portion 610 supplies the image signals Gn to the memory 620, the LUT 630, and the operation processing portion 640.

The memory 620 supplies image signals for previous frame, Gn−1 previously stored to the LUT 630 and the operation processing portion 640, and stores image signals for current frame, Gn from the signal receiving portion 610. The memory 620 stores image signals by a frame and may be affixed to the image signal modifying portion 650. Further, the memory 620 comprises a frame memory, etc, for example.

Referring to FIG. 7, the LUT 630 has 17×17 (or 9×9) matrix. Lows and columns of the matrix indicate the image signals for the previous and current frames, Gn−1, Gn, respectively, and parameters, P1, P2, P3, P4 for the reference temperatures are stored at intersecting points of the lows and columns of the matrix. The LUT 630 receives the image signals for previous and current frames, Gn−1, Gn and the temperature T, and supplies parameters, P1, P2, P3, P4 to the operation processing portion 640. The LUT 630 may be affixed to the image signal modifying portion 650. In this embodiment, since the LUT 630 stores coefficients of quadratic equation according to the number of the temperatures, the size of the LUT 630 may be reduced.

The operation processing portion 640 comprises a first operation portion 642 and a second operation portion 644. The first operation portion 642 calculates reference data for modification corresponding to the image signals for previous and current frames, Gn−1, Gn and the temperature T using the PQI. The second operation portion 644 receives reference data for modification from the first operation portion 642, and calculates modified image signals Gn' with respect to the Gn−1 and the Gn using linear interpolation, etc.

Operation of the operation processing portion 640 will be described in more detail with reference to FIGS. 7 and 8.

Referring to FIGS. 7 and 8, when an image signal for previous frame Gn−1 is "40" gray level, an image signal for current frame Gn is "216" gray level, and a temperature T is x, a point corresponding to these conditions is marked as TP in FIG. 8. In this case, the reference data for modification for the image signal for previous frame Gn−1 are "32" and "48" gray levels, the reference data for modification for the image signal for current frame Gn are "208" and "224", and the reference temperatures are $x_2$ and $x_3$. The first operation portion 642 receives coefficients of quadratic equation, P1=[$P_{11}$, $P_{12}$, $P_{13}$], P2=[$P_{21}$, $P_{22}$, $P_{23}$], P3=[$P_{31}$, $P_{32}$, $P_{33}$], P4=[$P_{41}$, $P_{42}$, $P_{43}$], at the temperature ($x_2$, $x_3$) with respect to a combination of the reference data for modification, (32, 208), (48, 208), (32, 224), (48, 224) from the LUT 630, and calculates the reference data for modification, $y_{00}'$, $y_{01}'$, $y_{10}'$, and $y_{11}'$ with respect to the temperature x. The second operation portion 644 calculates modified image signals Gn' according to the reference data for modification $y_{00}'$, $y_{01}'$, $y_{10}'$, and $y_{11}'$ from the first operation portion 642.

In this embodiment, the modified image signals Gn' are calculated by the four combinations of the reference data for modification for the image signals for previous and current frames, Gn−1, Gn, but may be calculated by three or two combinations of the reference data for modification according to any interpolation method.

Consequently, the present invention may reduce the size of the memory by calculating modified image signals with respect to the temperature using PQI and improve the display quality of the LCD device by calculating modified image signals considering variation in the temperature.

Having described the embodiments of the present invention and its advantages, it should be noted that various changes, substitutions and alterations can be made herein without departing from the spirit and scope of the invention as defined by appended claims.

What is claimed is:

1. A liquid crystal display (LCD) device comprising:

a liquid crystal panel assembly;

a sensor which senses a temperature to determine a sensed temperature;

an image signal modifying portion which receives image signals and the sensed temperature, calculates a plurality of modified reference data at the sensed temperature for a set of image signals of previous frames and current frames using coefficients of a quadratic expression of temperature, and generates a modified image signal at the sensed temperature according to the plurality of the modified reference data; and a data driving portion which converts the modified image signal into a data voltage and supplies the data voltage to the liquid crystal panel assembly, wherein each modified reference data of the plurality of modified reference data is equal to $p_1x^2+p_2x+p_3$, where p1, p2 and p3 are the coefficients of the quadratic expression, and x is the sensed temperature.

2. The LCD device of claim 1, wherein the coefficients of the quadratic expression are determined by reference data at reference temperatures.

3. The LCD device of claim 2, wherein the image signal modifying portion comprises at least one look-up table storing the coefficients of the quadratic expression.

4. The LCD device of claim 3, wherein the image signal modifying portion further comprises a memory, and the memory outputs image signals for previous frame previously stored and stores image signals for current frame.

5. The LCD device of claim 4, wherein the memory comprises a frame memory.

6. The LCD device of claim 3, wherein the coefficients of the quadratic expression are determined by three combinations of dynamic capacitance compensation (DCC) reference data at each of the reference temperatures.

7. The LCD device of claim 6, wherein intervals of the reference temperatures are irregular.

8. The LCD device of claim 1, wherein the image signal modifying portion linearly interpolates the plurality of modified reference data to generate the modified image signal.

9. The LCD device of claim 1, wherein the sensor is affixed to the liquid crystal panel assembly.

10. The LCD device of claim 1, wherein the sensor is formed on the liquid crystal panel assembly.

11. A method of modifying image signals, comprising:

sensing a temperature to determine a sensed temperature;

calculating a plurality of modified reference data at the sensed temperature for a set of image signals of previous frames and current frames using coefficients of a quadratic expression of temperature; and generating a modified image signal at the sensed temperature by interpolation of the plurality of modified reference data wherein each modified reference data of the plurality of modified reference data is equal to $p_1x^2+p_2x+p_3$, where p1, p2 and p3 are the coefficients of the quadratic expression, and x is the sensed temperature.

12. The method of claim 11, wherein the coefficients of the quadratic expression are determined by reference data at reference temperatures.

13. The method of claim 12, wherein the coefficients of the quadratic expression are determined by three combinations of dynamic capacitance compensation (DCC) reference data at each of the reference temperatures.

14. The method of claim 13, wherein intervals of the reference temperatures are irregular.

* * * * *